United States Patent [19]

Norisugi

[11] 4,146,982

[45] Apr. 3, 1979

[54] PUMP-TYPE SLUDGE DREDGING APPARATUS

[75] Inventor: Makoto Norisugi, Kawasaki, Japan

[73] Assignee: Toa Harbor Works Co., Ltd., Tokyo, Japan

[21] Appl. No.: 800,930

[22] Filed: May 26, 1977

[51] Int. Cl.[2] ..... E02F 3/92

[52] U.S. Cl. ..... 37/64; 37/58

[58] Field of Search ..... 37/72, 64–67, 37/61–63, 58, 57

[56] References Cited

U.S. PATENT DOCUMENTS

| | | | |
|---|---|---|---|
| 70,849 | 11/1967 | Howell | 37/58 |
| 567,443 | 9/1896 | Bacon | 37/58 |
| 634,865 | 10/1899 | Bates | 37/72 X |
| 1,778,942 | 10/1930 | Harp | 63/ |
| 3,738,029 | 6/1973 | Harmon | 37/66 |
| 3,971,148 | 7/1976 | Deal | 37/66 |
| 3,975,842 | 8/1976 | Andreae | 37/63 X |

FOREIGN PATENT DOCUMENTS

| | | | |
|---|---|---|---|
| 2413738 | 10/1974 | Fed. Rep. of Germany | 37/66 |
| 1187415 | 3/1959 | France | 37/61 |
| 298911 | 8/1965 | Netherlands | 37/67 |

*Primary Examiner*—Clifford D. Crowder

*Attorney, Agent, or Firm*—Armstrong, Nikaido, Marmelstein & Kubovcik

[57] ABSTRACT

An improved pump-type sludge dredging apparatus including a pump dredger having a first ladder, a sludge suction pump acting in cooperation with the ladder and pump dredger, a suction pipe, a second ladder, a suction device suspended from the second ladder and connected to the pump through a suction pipe, a rotator, a half-cylindrical sludge collector plate, a substantially inverted U-shaped body structure, a grating, movable vanes disposed outside the grating and gas collecting chambers.

7 Claims, 7 Drawing Figures

A
K
D
G
F
E
E
L
I
B
J
H
C

J
L
M
C
P
S
O
N
X
Q
R 1
1
I
4
17
16
L
4
18
16
21
11
19
M
20
30
46
X
47
49
53
50
39
48
39
53
50
15
51 (52)
45
12
54
S
P
22
N
23
31
54
Q
45
14
10

IMPROVED PUMP-TYPE SLUDGE DREDGING APPARATUS

BACKGROUND OF THE INVENTION

This invention relates to a water bottom dredging apparatus, and more particularly to a dredging apparatus for removing sludge, ooze and the like on the water bottom with high sludge concentration, without causing turbulence of sludge in water, by use of a combination of a specific suction head and a pump unit.

Recently, accumulation of sludge or muddy refuse of various kinds, including refuse from living life and industrial waste, has advanced seriously in the estuaries, water and sea ports, lakes, swamps, etc., and the necessity for removing such sludge has become acute. Under such circumstances, attempts are being made widely for improving the living environment by dredging the embayments, lakes, marshes and so forth. There is generally employed for such dredging a method in which the suction head of a pump is set at a place to be dredged to pump out sludge at such place and pumped-out sludge is transferred along with water to the other place, and in such method is used a dredging machine having a construction suited for the area to be dredge. A typical example of such dredging machines is disclosed in Japanese Patent Laid-Open No. 28741/1972. The dredging machine shown in this Japanese Patent is constituted essentially from a pump, a suction pipe adapted to said pump, an end-spread suction head secured to the end of said pipe and arranged movable underwater, and a plurality of screw augers mounted at the end of said suction head. This machine has an excellent dredging performance and allows efficient removal of sludge, but it still leaves room for further improvements for performing effective dredging and transfer of sludge. Generally it is required in this type of dredging machines that the dredging operation can be accomplished without disturbing sludge to keep water in the dredged region non-turbid, that the area where disturbance of water current is caused in the dredged region is minimized, that sludge can be pumped out with high concentration, that the gas produced from sludge during the dredging operation can be recovered, that there is no "leftover" of sludge, and that even coarse or large-sized debris can be removed out. The dredging machine of the above-cited Japanese patent does not fulfill these requirements to a satisfactory degree. That is, this dredging machine can not meet all of these requirements and is low in dredging efficiency and also unable to perform smooth transfer of sludge water by a pump. When the sludge concentration in the sludge water is too low, too much time and energy are required for the dredging operation, while when the sludge concentration is too high, there could take place deposition of sludge or clogging in the sludge water transfer sytem. Also, it is hard to provide sludge water with controlled sludge concentration in the conventional apparatus, because the screw auger assembly is covered at the upper portion thereof merely by a single piece of hood. Thus, the conventional dredging apparatuses of this type are still open to further improvements.

OBJECT OF THE INVENTION

The primary object of this invention is to provide a dredging apparatus with high dredging efficiency. Another object of this invention is to provide a dredging apparatus which is capable of performing the dredging operation without disturbing sludge and whereby the area where water current is disturbed by the dredging operation in the dredged region is confined to the minimum to minimize turbidity of water and it is also possible to recover the gas produced from sludge during the dredging operation and to perfectly remove sudge without causing any "leftover".

BRIEF SUMMARY OF THE INVENTION

The above-said objects of this invention can be accomplished by using an apparatus which consists of the following essential elements (a) to (k);

(a) a pump dredger having a first ladder which is fixed at its one end and movable at its other end in water, with the said fixed end serving as a fulcrum;
(b) a sludge suction pump adapted at at least one of said ladder and pump dredger;
(c) a suction pipe adapted to said pump,
(d) a second ladder located in close proximity to the end of said pipe and connected to the end of said first ladder and also provided with a buoyancy adjusting mecnanism;
(e) a suction device suspending from said second ladder and connected to said pump through said suction pipe;
(f) a rotator comprising a horizontally mounted rotatable shaft arranged parallel to the central axis of the ship body in said suction device and below the spread-out end opening of said suction pipe, said rotator being adaptable to gather sludge toward the central portion of said shaft;
(g) a half-cylindrical sludge collector plate adapted to substantially surround said rotator in cooperation with said opening to form a sludge stirring chamber and also having a function to open and close the sludge inlet provided on the advancing side of said rotator shaft;
(h) a substantially inverted U-shaped body structure comprising a body cover member and two side walls, said body cover member being adapted to hold said rotator shaft and sludge collector plate in position and to also partition the body structure into the front and rear portions;
(i) a grating disposed at the sluge inlet to prevent the coarse obstacles from entering said stirring chamber during movement of said suction device;
(j) movable vanes disposed outside of said grating at said inlet and adapted to guide sludge toward said inlet whle preventing inflow of superflous water; and
(k) gas collecting chambers provided in the body cover and located above the end of said movable vane assembly for collecting the gas produced during the dredging operation.

DETAILED EXPLANATION OF THE EMBODIMENTS

Figure 1:
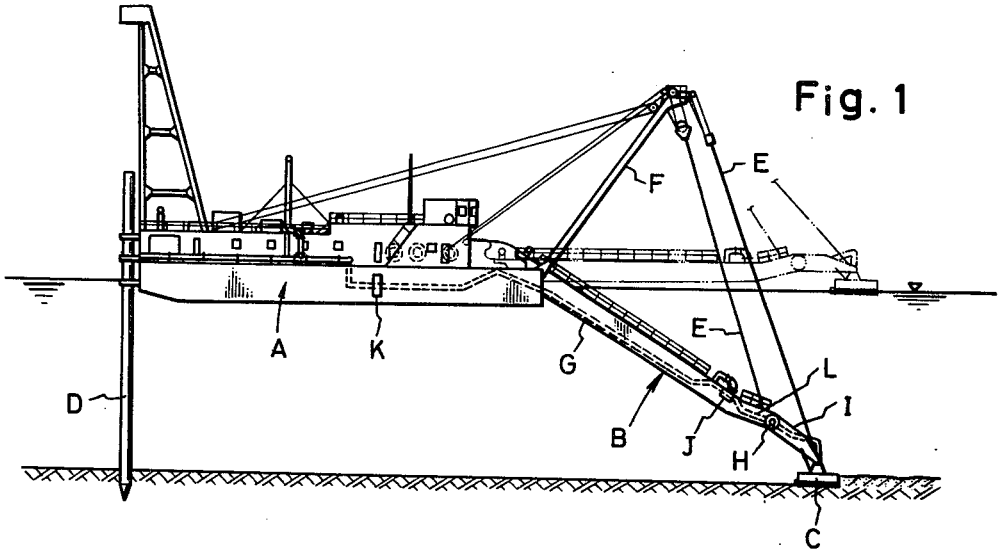
FIG. 1 is a general view of the dredging apparatus in accordance with the present invention.
Figure 2:
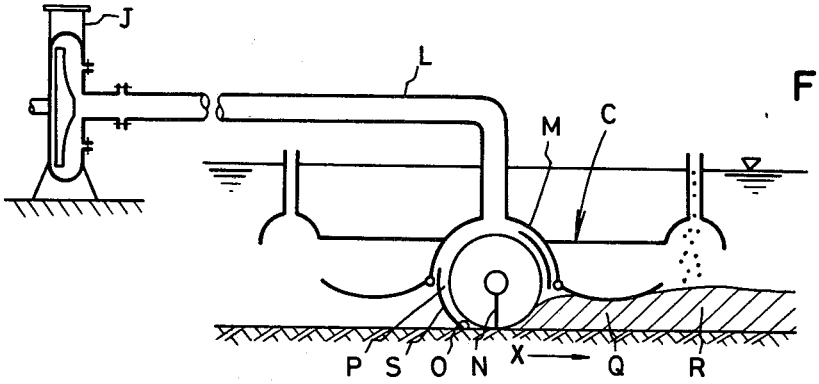
FIG. 2 is a diagrammatic drawing for illustrating the fundamental structure of the apparatus according to this invention.

Now, the dredging apparatus of the present invention is described in detail with reference to the drawings. Described first is the operational principle of the apparatus. FIG. 1 shows a general view of the apparatus according to this invention, and FIG. 2 is a diagrammatic illustration of the basic structure of the apparatus. The apparatus of this invention, as shown in FIG. 1, consists of the following three principal components; pump dredger A, ladder assembly B and suction device C. The pump dredger A has an operator's cabin where the ladder assembly B and suction device C are operated, and pumps for sucking and discharging sludge water and for supplying operating oil into a hydraulic motor to be described later. It is also provided at its stern a spud D for holding the dredger A in a predetermined range of activity and at its bow an arm F for hoisting up or down the end of each ladder through a sling E as described later. The ladder assembly B comprises a first ladder G of which one end is secured to the dredger A to provide a fulcrum and the other end is suspended by the sling E, and a second ladder I which extends out from the end of said first ladder G and whose one end is secured to the first ladder and the other end is arranged swingable slightly about the fulcrum H. Said second ladder I is also incorporated with a buoyancy adjusting mechanism to be described later. The first ladder G is also provided with a main pump J for sucking up and discharging sludge water, said main pump J being adapted to cooperate with an auxiliary pump K in the dredger A to pump up sludge water from the area to be dredged through a suction pipe L extending from the suction device C and transfer such sludge water to other place, for example a place for reclamation.

The suction device C, as shown in FIG. 2, comprises essentially an opening M which spreads out from the end of said suction pipe L and houses therein a rotator N, said rotator N comprising a shaft arranged rotatably below said opening M and vanes secured to said shaft for gathering sludge toward the central portion thereof, and a sludge collector plate S provided behind said rotator N and adapted to form a sludge water stirring chamber P in cooperation with the opening M and the sludge cutting face O so as to collect sludge R from the inlet Q and cutting face O. The inlet Q is formed on the side where the sludge collector plate S is not provided, that is, forwardly of the rotator N in the direction of its advancement.

The high concentration sludge suction type dredging apparatus of this invention, which basically consists of the above-described elements, performs the dredging operation according to the following operating principle.

First, the ladder assembly B of the dredger A is lowered down into water until the suction unit C contacts sludge R on the water bottom, and then while operating the pumps J, K, the dredger A is moved (more accurately, swung) in the direction of arrow X about the spud D, whereby sludge R is collected into the stirring chamber P by the sludge collector plate S, and the sludge water cut and stirred by the rotator N is pumped up and discharged out by the operation of said pumps J, K. When dredging is made to a predetermined position, the dredger A is now advanced forwardly and the sludge collector plate S is turned a half turn to let the inlet Q face in the opposite direction, and the dredging operation is repeated under this condition. This is the basic principle of the dredging operation.

In this operation, however, effective and efficient dredging can hardly be accomplished unless the aforesaid requirements are met. In other words, it is required for the successful dredging operation that no excess disturbance of sludge is caused before it is taken into the stirring chamber P, and that the area where water current is disturbed by the dredging operation is minimized to allow capturing of high concentration sludge into the stirring chamber P and hence the opening M. It is also an essential requirement that the gas, such as methane or hydrogen sulfide gas, generated from the sludge cutting and collecting operations be removed out smoothly from the dredging area, because otherwise water pollution is bound to be caused.

In the present invention, in order to fulfill these requirements, improved arrangements are made to define the range of disturbance of sludge water caused by the operation of the rotator N to allow efficient drawing of sludge into the opening M. Thus, the present invention features many of these improvements added to the apparatus composed of the above-noted basic elements.

The first salient improvement embodied in this invention is that the suction unit C itself was made able to soft-land on any spot in the area to be dredged. The second important improvement is that the structure of the suction unit C itself was so specified as to allow transfer of high-concentration sludge water to the opening M.

We will now describe in detail how these improvements were embodied in the apparatus of this invention while having reference to FIGS. 3 to 7 of the accompanying drawings.

Figure 3:
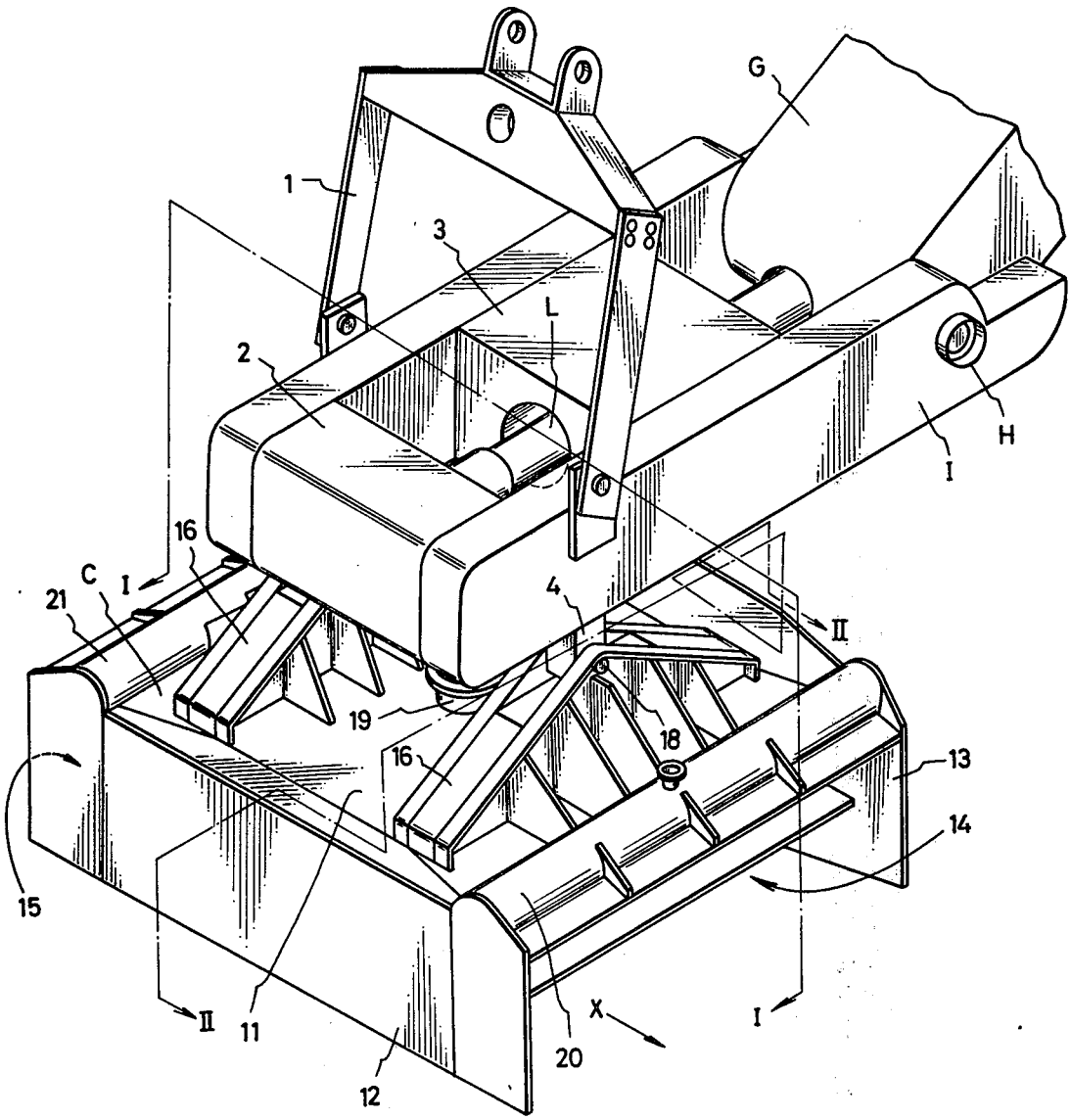
FIG. 3 is a perspective view showing a condition where a suction device was mounted at the end of the ladder assembly.

Referring first to FIG. 3, there is given a perspective view showing a way of adaptation of the suction unit C to the second ladder I. The second ladder I, as noted from FIG. 3, has its one end pivotally secured to the corresponding end of the first ladder by a pivot H and has provided at its other end a connecting element 1 to which a sling is connected to thereby suspend said end of the ladder I. Said second ladder I is also provided with a buoyancy adjusting mechanism comprising one or more chambers 2, 3 designed to allow controlling of buoyancy by adjusting the water and air feeds. It also retains therein a suction pipe L which extends from the first ladder G into the suction unit C. Provided on the underside of said second ladder are two suspending elements 4 for suspending the suction unit C.

The second ladder I has a basic structure such as described above, but this structure is not critical but may be altered in other suitable form, provided that it can produce the following actions.

Soft landing of the suction unit onto the area to be dredged can be accomplished in the following way. With the pump dredger A being held in position by the spud D as shown in FIG. 1, the ladder assembly B is turned from the position partially shown by the chain line to the position shown by the solid line to move the suction unit C into water. As the second ladder I is provided with a buoyancy adjuster, its end portion has a tendency to float up even if the end of the first ladder G descends rapidly under the gravitational force. Therefore, descending speed of the end portion of the first ladder G and the force applied thereto are markedly lessened although they are transmitted to the second ladder I. Accordingly, the suction unit C adapted to the lower end of the second ladder I is slowed down in its descent into water, and hence it can make a soft-landing on the sludge layer at the water bottom without disturbing sludge.

Now the structural details of the suction unit C are described by referring first to FIG. 3. This unit C, substantially inverted U-shaped in external appearance, consists basically of a body cover 11 and two side walls 12, 13 (numbers 5 to 10 are not used in the drawings) and houses therein an open portion M, a rotator N, a stirring chamber P and other members to be described later. The suction unit C is movable back and forth in the direction of arrow X in FIG. 3, and such movement can be effected by turning the pump dredger A clockwise or counterclockwise about the spud D along with the ladder assembly B. Therefore, the direction of the bow or stern of the pump dredger A does not agree with the direction of advancement of the suction unit C, and hence the direction of forward movement or reverse movement of the suction unit C is the direction in which the bow of the dredger A turns to the right or to the left on the horizontal plane about the spud D, that is to say, the direction of the starboard or port of the dredger A. (The terms "forward movement" and "reverse movement" of the suction unit C or rotator N are used in this sense in the following description of the invention).

The unit C has no wall on its front and rear sides (in the direction of forward or reverse movement) and instead there are formed openings 14 and 15 so that sludge is taken into the unit from either of these openings. Thus, the suction unit C has a same function for both forward and reverse movements and the front and rear portions are constructed symmetrically to each other, centered by the rotator N.

The body cover 11 is provided with a pair of metal fittings 16 for connecting the suction unit C to the suspending elements 4 of the second ladder I. Each of said metal fittings 16 has the form of an equilateral triangle and a pin 18 is fitted in the pin hole 17 (not seen in FIG. 3) formed near the opex of the triangle. It will be also seen that the flange 19 of the suction pipe L is provided in the central part of the body cover 11, wherebty said pipe L is communicated with the opening M.

Provided above the openings 14 and 15 of the body cover 11 are the gas collecting chambers 20 and 21 for capturing and collecting the gas generated from sludge during the dredging operation.

As shown in FIG. 2, when the suction unit moves in the direction shown by arrow X, a gas such as methane gas contained in sludge becomes liberated out of the sludge due to the contact of the suction unit with the sludge and bubbles up in the water.

If the suction unit is permitted to move in its condition containing a great volume of the thus liberated gas bubbles beneath the cover member or flat plate member, the sludge R becomes disturbed by bubbles before it is taken into the stirring chamber P through its inlet Q, with the result that the water in the operation area is made turbid by the sludge portion disturbed by gas bubbles as above. Accordingly, it is required that the suction unit is moved with the sludge as little disturbed as possible before it is taken into the chamber P.

Thus, in order to have the gas bubbles generated in accordance with the movement of the suction unit discharged as quickly as possible, there are chambers 20 and 21 provided for collecting the gas bubbling up in the water along the lower surface of the shield plate 47 mounted below the body cover 11 and for rapidly discharging the collected gas out of the suction unit. Each of the gas collecting chambers 20 and 21 has a gas discharge pipe connected to its apex. A bottom plate may be provided at the lower ends of the side walls 12 and 13 for prevening subsidence of the suction unit C and facilitating its movement. Formed in the inside of the side walls 12, 13, although not seen in FIG. 3, is a chamber housing a hydraulic cylinder and a hydraulic motor for driving the rotator shaft, said chamber being defined by a side wall cover to be described later.

Figure 4:
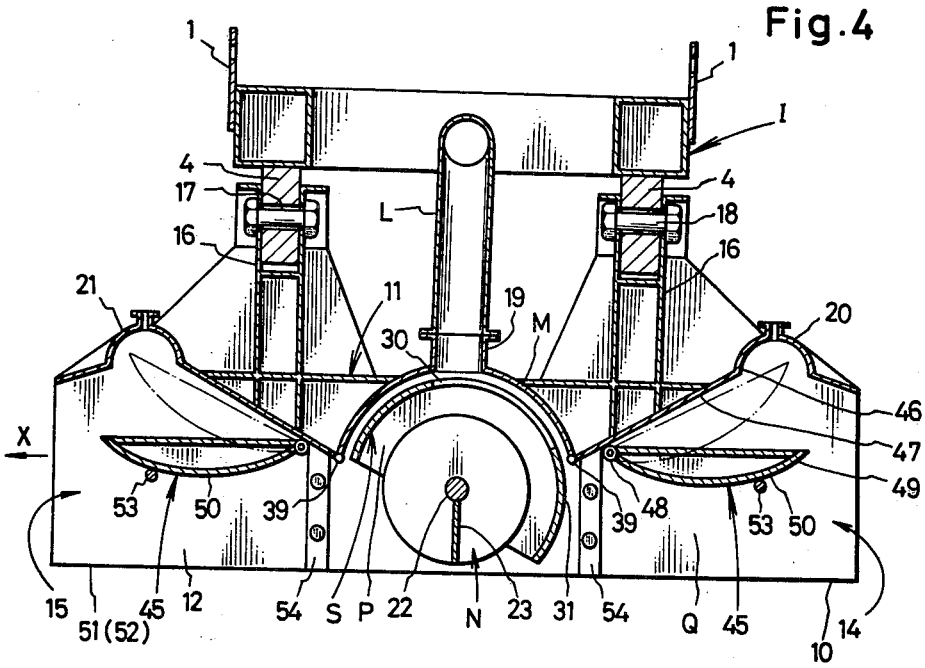
FIG. 4 is a sectional view taken along the line I—I of FIG. 3 and in the direction of arrows.
Figure 5:
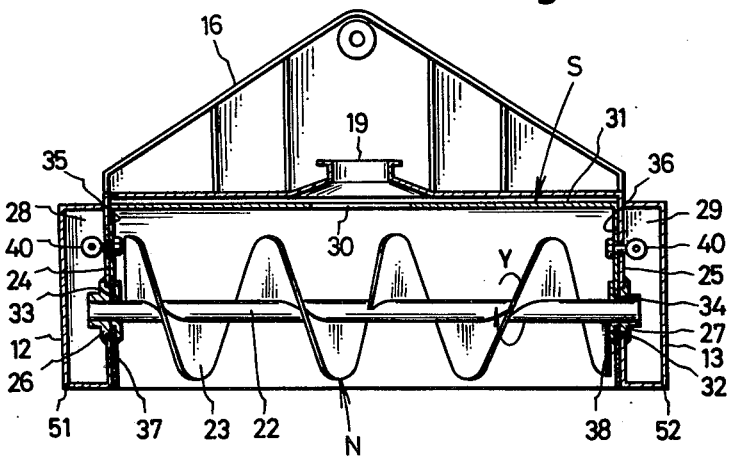
FIG. 5 is a sectional view taken along the line II—II of FIG. 3 and in the direction of arrows.
Figure 7:
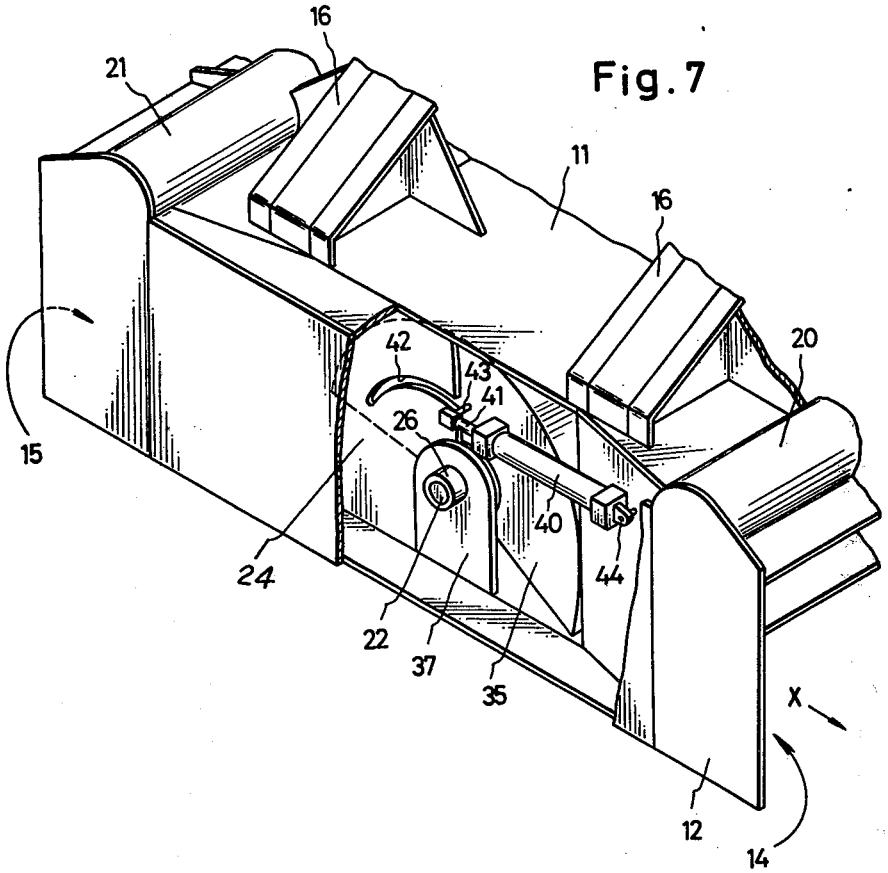
FIG. 7 is a partial perspective view of the suction device showing, in particular, the section where a hydraulic cylinder is mounted.
Figure 6:
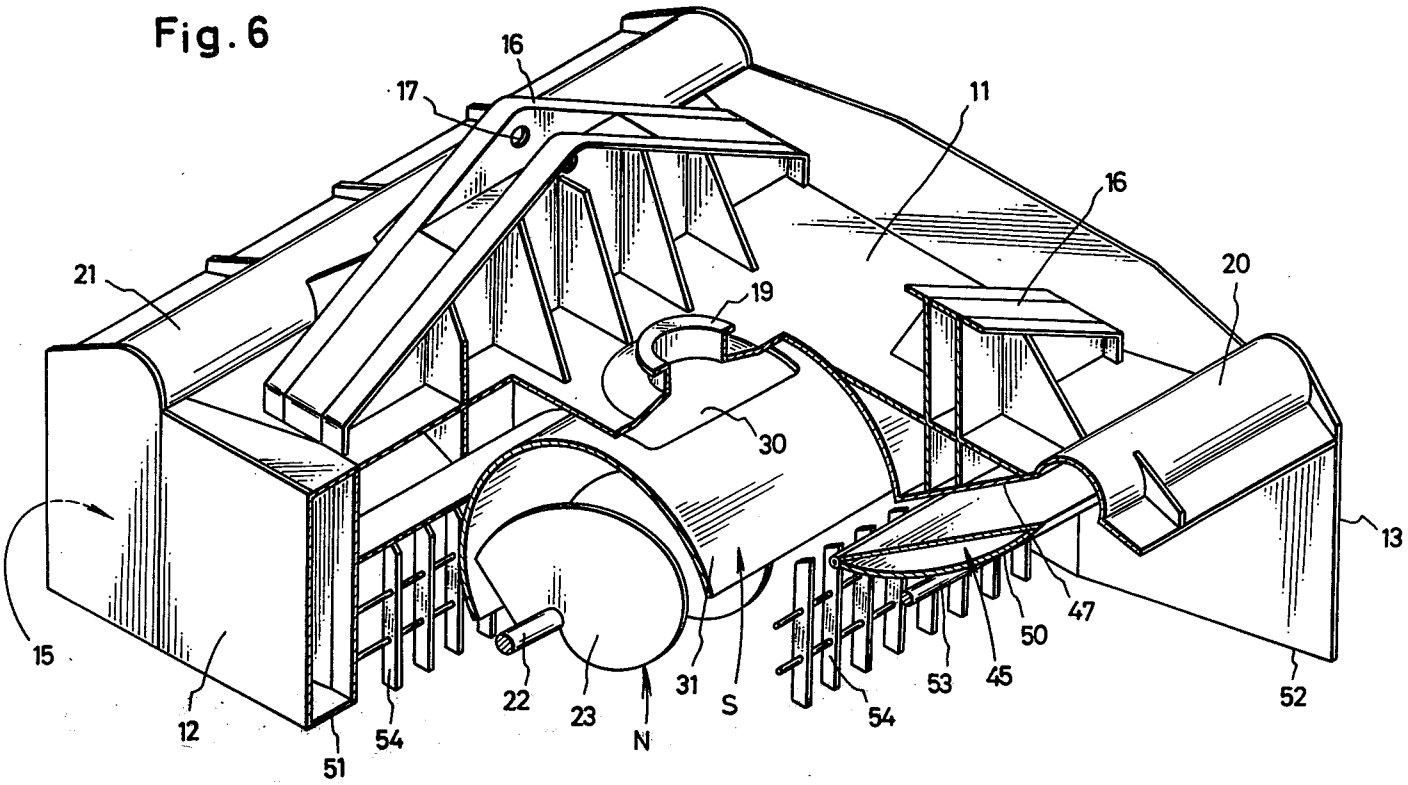
FIG. 6 is a perspective view of the suction device, with parts cut away.

Now, the internal mechanism of the suction unit C is described in detail with particular reference to FIGS. 4 and 5 which show the sectional views taken along the lines I-I and II-II, respectively, of FIG. 3 in the direction of arrows. The open portion M of the suction pipe L is fixed in the central lower part of the body cover 11 of the suction unit C, and the rotator N is mounted in the stirring chamber P formed therebelow. As shown in FIG. 5, the rotator N consists of a shaft 22 and moving vanes 23 such as screw vanes, and the shaft 22 is journalled at its both ends by bearings 26 and 27 secured to the side covers 24 and 25 provided inside of the side walls 12 and 13. Between the side wall 12 and side cover 24 and between the side wall 13 and side cover 25 are formed the hydraulic cylinder chambers 28 and 29, respectively, each of said chambers being designed to house therein a hydraulic cylinder described later. In one of said chambers is provided a hydraulic motor (not shown) for rotating the shaft 22, and pressurized oil is supplied to this motor from the pump dredger A to drive the rotator N. The rotator N may be of a type provided with said screw type vanes on the shaft 22 or a type provided with turbine blades. It is however desirable to use screw type vanes such as shown in FIG. 5, and preferably the winding direction of the helix is reversed at the middle of the shaft 22. For, when the shaft is turned in the direction of arrow Y, sludge is drawn toward the central part of the shaft 22 and gathered below the suction pipe L to further enhance the dredging effect. Between said rotator N and opening M is provided a sludge collector plate S which has the form of a cylinder of which a part was cut out longitudinally along a line not passing the center of the cylinder and which is formed with a hole in its central part. A partial perspective view of this sludge collector plate S is shown in FIG. 6. As noted from the figure (where the rotator N is also shown in partial perspective), the sludge collector plate S consists of a curved plate portion 31 having in its middle part a hole 30 so formed as will not intercept the sucking section of the suction pipe L when said plate S was turned in the manner described later, and two end plates 35, 36 adapted to support said curved plate portion 31 and formed with holes 33, 34 (actually, contact pieces 32 of the shaft 22 are fitted in these holes) through which the shaft 22 extends. Also, as seen in FIG. 5, the sludge collector plate S is swingably supported, through contact pieces 32, by the bearings 26, 27 directly secured to the side covers 24, 25, or by the supports 37, 38 mounted separately along the side covers 24, 25. Of course, the supports 37, 38 may be formed integral with the contact pieces 32, or the contact pieces 32 may be directly provided in the side covers 24, 25 without using said supports 37, 38. As understood from FIG. 4, the angle of turn and the arc length of the curvature 31 may be altered depending on the mounted height of the shaft 22 and the level of the lowermost end 39 of the opening M, but preferably the sludge collector plate S is adapted swingable partially so that when the suction unit C moves forwardly said plate S will be open in the direction of forward movement, and when the unit C moves reversely said plate S will be open in the direction of reverse movement so as to allow entrance of sludge into the stirring chamber P while effecting collection of sludge on the rear side of the rotator N. Supposing that the direction of arrow X in FIG. 4 is the direction of forward movement, there is depicted therein a condition where the sludge collector plate S is open in the direction of forward movement. The turning motion of the sludge collector plate S is effected by hydraulic cylinders mounted in position by the two end plates 35, 36. FIG. 7 shows a partial perspective view of the suction unit C, with the hydraulic cylinder chamber 28 (or 29) being cut open. As an end of the piston rod 41 of each hydraulic cylinder 40 is connected to the end plate 35 (or 36) by a connecting bar 43 through a groove 42 formed in the side wall cover 24 (or 25), the sludge collector plate S is allowed to turn slightly about a pivot 44 at an end of the hydraulic cylinder 40. Such hydraulic cylinder 40 is provided in each of the two hydraulic cylinder chambers 28 and 29.

Also provided in the suction unit C are moving vanes which constitute one of the salient features of the apparatus of this invention. These moving vanes are designed to help taking in sludge in bulks into the stirring chamber and to regulate the amount of sludge taken in while excluding superfluous water to admit highly concentrated sludge water into the stirring chamber. It is also so designed as to give suitable buoyance to the entire suction unit C to promote the dredging effect.

As shown in FIGS. 4 and 6, the lowermost end 39 of the opening M and the corresponding lowermost end 46 of the gas collecting chamber 20 (or 21) are joined by a shield plate 47, and an end 48 of each hollow arcuate movable vane 45 is secured to the middle or other suitable part of said shield plate such that said vane is turnable at its other end 49 about said fixed end 48. Thus, a sludge intake Q is formed between the arcuate surface 50 of said movable vane 45 and the corresponding part of the lower face 51 (52) of each side wall 12 (13). Of course, when the suction unit C moves, each movable vane 45 turns and its arcuate surface 50 descends, so that the sludge intake Q is formed only on the side where the suction unit C moves, and no such intake is formed on the opposite side. That is to say, when the suction unit in FIG. 4 is moved in the direction of arrow X, the arcuate surface of the end portion of the vane, 49 (this numerical reference is omitted of the left vane in FIG. 4), goes up, whereby the vane eventually takes the position shown by the phantom lines and, while pressing down the sludge portion to be taken into the stirring chamber, facilitate the collection of sludge into such chamber. When the unit is moved in the opposite direction, the end portion 49 of the right side located vane in FIG. 4 undergoes pivotal movement toward up in the same manner as above, and the end of the left side vane comes down. The vanes 45 of the suction unit are thus adapted to operate a pivotal movement automatically in accordance with the movement of the suction unit and responsive to the function of water. It is desirable to limit the opening of the movable vane 45 by providing a stopper 53 on each side cover 12, 13 so that such opening will not become smaller than a certain degree.

Described above are the essential fundamental structural elements of the apparatus according to this invention, but it is also desirable to provide a grating 54 (see FIG. 4 and 6) at the intake Q so as to keep off the coarse obstacles such as rocks or buried blocks of dead trees which may exist in sludge and may suddenly manifest themselves and try to enter the intake Q during the dredging operation.

The apparatus of this invention is also subject to the following alternations.

It has been described and shown in the drawings that two movable vanes 45 are provided and the sludge collector plate S is movable, but such sludge collector plate S may be fixed to let it perform its sludge collecting function to the full while providing a movable vane 45 only on the side where no sludge collector plate is present so that said movable vane is always positioned in the direction of advancement of the dredging operation. Also, an earth pressure gauge may be provided in the body portion, movable vane 45 or other elements, thereby to detect earth pressure in the stirring chamber P to further elevate the dredging efficiency. Further, a water supply pipe may be connected into the opening M to supply water into the stirring chamber P so that sludge water of a preferred concentration will be always provided.

In operation of the apparatus of this invention composed essentially of the afore-said elements (a) to (k), when the suction unit moves sidewise horizontally, sludge is guided into the intake along the moving vanes from the front side of the apparatus, with the coarse matters being screened off by the grating, and further led into the stirring chamber sectioned like a closed compartment by the sludge collector plate. In this chamber, sludge and water are stirred and mixed into sludge water by the screw-like rotator and supplied into the dredging pump through the suction pipe connected to the top of said suction unit.

The screw-like rotator has the double functions of stirring up sludge in said stirring chamber and digging up sludge therebelow while leveling the dredged water bottom. As the lower end of the sludge collector plate positioned behind the rotator stays flush with the lower end of the screw, no sludge is left over in the dredged area. Any gas present in sludge is separated from sludge when guided into the intake, and the separated gas flows up along the moving vanes and is collected in the gas collecting chambers provided at both right and left ends of the suction unit. In this way, sludge to be removed is guided into the stirring chamber constituted by an open portion and a sludge collector plate and is stirred and mixed therein, so that no turbidity is caused outside of the suction unit and the mixed muddy water formed in said unit is pumped up by a suction pump causing no turbidity in water therearound.

In performing the dredging operation, two anchors cast through the sheaves at the end of the ladder assembly are weighed up by a winch mounted aboard the dredger, whereby the dredger is allowed to swing sidewise about the spud secured to the stern of the dredger. The suction unit is constructed symmetrically at both right and left portions thereof so that it allows the dredging operation no matter which direction it moves. The second ladder provided at the end of the ladder assembly is hollowed in its inside to provide a tank, and water is supplied thereinto or discharged out therefrom so as to adjust buoyancy, allowing adjustment of the ground engaging pressure of the bottom face of the suction unit suspended from said second ladder. Thus, the buried depth of the suction unit in the sludge layer can be set optionally, allowing the perfect dredging operation on the water bottom.

The essential mechanical arrangements and operation of the apparatus according to this invention have been substantially described above, but addition of some other means and alternations of the described arrangements are also possible. Including these additional means, the apparatus of this invention may be summarized as follows.

The apparatus of this invention has an operating mechanism whereby the sludge water disturbed region is limited to the smallest area necessary for dredging and which allows suction of sludge water in a way maximizing the dredging efficiency. There is no possibility that sludge water be diluted to any excess degree or the suction pipe be clogged with sludge.

The grating can prevent the coarse obstacles present in sludge from entering the sludge intake of the apparatus. These obstacles are carried to the terminal end of movement of the apparatus, and when the apparatus is reversed in its direction of movement, such obstacles are left there. In addition to such obstacle excluding function, said grating also acts to support the sludge collector plate when the apparatus moves in the opposite direction.

According to the apparatus of this invention, the suction unit can be adapted to the undulations on the water bottom by the operation of the second ladder provided with a buoyancy adjuster, allowing the dredging operation with high sludge concentration and free of secondary pollution.

The movable vanes are joined to the body portion of the suction unit so as to be turnable up and down. The vane positioned on the side opposite from the direction of movement is lowered down to prevent floating of sludge by the eddy of water and minimize dispersion of earth particles.

Provided alongside the apparatus are the side walls designed to guide sludge and also adapted to prevent ingress and egress of sludge due to pressure difference between the inside and outside of the apparatus. In case it is found that there exists below sludge a hard layer which needn't be removed, it is recommendable to attach sleds to the bottom ends of the side walls. If such sleds are attached, the lower end of the vane won't get into the sand layer as the sleds are held by the surface of such sand layer, so that sludge alone on the sand layer is collected and removed.

Further, since the chambers for collecting gas generated from sludge are provided in the body cover, there is no possibility that water be disturbed by release of gas, thus eliminating any risk of unnecessary stir-up of sludge.

What is claimed is:

1. A dredging apparatus for removing sludge on a water bottom comprising:

(A) a pump dredger having a ladder assembly, said ladder assembly being pivotally supported at its one end at a fulcrum mounted to said pump dredger with its other end movable in water;

(B) a sludge suction pump provided in at least one of said ladder assembly and said pump dredger;

(C) a suction pipe connected at its one end to said suction pump and extending to the movable end of said ladder assembly; and (D) a suction unit pivotally mounted through a pin at a portion of said movable end of the ladder assembly and having the other end of said suction pipe connected thereto, said suction unit comprising:

(a) a main body essentially composed of a cover or flat plate member and two side walls altogether arranged in a sectional configuration substantially corresponding to an inversed U-letter shape in a direction perpendicular to the longitudinal direction in which the ladder assembly extends from the pump dredger;

(b) a hood-like member expanded or flared toward below and secured at a central portion of said cover member of the main body in communication with the suction pipe, defining an opening for collecting diluted sludge therein and guiding the same into the pipe;

(c) a rotatable member comprising a rotatable shaft and vanes mounted thereon, the axis of said rotatable member being directed substantially perpendicular to the face of said side walls of the main body, said rotatable shaft being disposed below said hood-like member;

(d) a sludge collector means disposed between the hood-like member and the rotatable member and having a structure corresponding to a cylindrical container longitudinally with a portion thereof removed away, formed by a curved surface plate and two end plates respectively disposed at a longitudinal end, said sludge collector means being rotatable coaxial with said rotatable member;

(e) a sludge inlet formed below the hood-like member for taking sludge into a lower portion of the hood-like member by means of the rotary movement of said curved surface plate of the sludge collector means; and (f) a movable vane member forming an upper wall of said sludge inlet and having a hollow arcuate configuration in longitudinal section; whereby as the suction unit is moved either forwardly or backwardly the dredging of sludge is carried out.

2. The apparatus according to claim 1, wherein said ladder assembly comprises a first ladder which is fixed at its one end to the pump dredger, and a second ladder extending out from the end of said first ladder.

3. The apparatus according to claim 2, wherein said second ladder has a buoyancy adjusting device built therein.

4. The apparatus according to claim 1, wherein said vanes mounted on the rotatable shaft of the rotatable member are screw-like blades.

5. The apparatus according to claim 4, wherein the winding direction of said screw-like blades is changed at the middle part of the shaft.

6. A dredging apparatus for removing sludge on a water bottom comprising:

(A) a pump dredger having a ladder assembly, said ladder assembly being pivotally supported at its one end at a fulcrum mounted to said pump dredger with its other end movable in water;

(B) a sludge suction pump provided in at least one of said ladder assembly and said pump dredger;

(C) a suction pipe connected at its one end to said suction pump and extending to the movable end of said ladder assembly; and (D) a suction unit pivotally mounted through a pin at a portion of said movable end of the ladder assembly and having the other end of said suction pipe connected thereto, said suction unit comprising:

(a) a main body essentially composed of a cover or flat plate member and two side walls altogether arranged in inversed U-letter shape in a direction perpendicular to the longitudinal direction in which the ladder assembly extends from the pump dredger;

(b) a hood-like member expanded or flared toward below and secured at a central portion of said cover member of the main body in communication with the suction pipe, defining an opening for collecting diluted sludge therein and guiding the same into the pipe;

(c) a rotatable member comprising a rotatable shaft and vanes mounted thereon, the axis of said rotatable member being directed substantially perpendicular to the face of said side walls of the main body, said rotatable shaft being disposed below said hood-like member;

(d) a sludge collector means disposed between the hood-like member and the rotatable member and having a structure corresponding to a cylindrical container longitudinally with a portion thereof removed away, formed by a curved surface plate and two end plates respectively disposed at a longitudinal end, said sludge collector means being rotatable coaxial with said rotatable member;

(e) a sludge inlet formed below the hood-like member for taking sludge into a lower portion of the hood-like member by means of the rotary movement of said curved surface plate of the sludge collector means; and (f) a grating provided about said sludge inlet for preventing from entering into the suction unit such matters as having so large a size as incapable of being dredged; whereby as the suction unit is moved either forwardly or backwardly the dredging of sludge is carried out.

7. A dredging apparatus for removing sludge on a water bottom comprising:

(A) a pump dredger having a ladder assembly, said ladder assembly being pivotally supported at its one end at a fulcrum mounted to said pump dredger with its other end movable in water;

(B) a sludge suction pump provided in at least one of said ladder assembly and said pump dredger;

(C) a suction pipe connected at its one end to said suction pump and extending to the movable end of said ladder assembly; and (D) a suction unit pivotally mounted through a pin at a portion of said movable end of the ladder assembly and having the other end of said suction pipe connected thereto, said suction unit comprising:

(a) a main body essentially composed of a cover or flat plate member and two side walls altogether arranged in a sectional configuration substantially corresponding to an inversed U-letter shape in a direction perpendicular to the longitudinal direction in which the ladder assembly extends from the pump dredger;

(b) a hood-like member expanded or flared toward below and secured at a central portion of said cover member of the main body in communication with the suction pipe, defining an opening for collecting diluted sludge therein and guiding the same into the pipe;

(c) a rotatable member comprising a rotatable shaft and vanes mounted thereon, the axis of said rotatable member being directed substantially perpendicular to the face of said side walls of the main body, said rotatable shaft being disposed below said hood-like member;

(d) a sludge collector means disposed between the hood-like member and the rotatable member and having a structure corresponding to a cylindrical container longitudinally with a portion thereof removed away, formed by a curved surface plate and two end plates respectively disposed at a longitudinal end, said sludge collector means being rotatable coaxial with said rotatable member; and (e) a sludge inlet formed below the hood-like member for taking sludge into a lower portion of the hood-like member by means of the rotary movement of said curved surface plate of the sludge collector means.

* * * * *